US009291052B2

(12) United States Patent
Willison et al.

(10) Patent No.: US 9,291,052 B2
(45) Date of Patent: Mar. 22, 2016

(54) AIR FLOW SYSTEM FOR MINING MACHINE

(71) Applicant: Joy MM Delaware, Inc., Wilmington, DE (US)

(72) Inventors: John Willison, Cranberry, PA (US); Richard D. Boyd, Balgownie (AU); Brad Neilson, Mt Keira (AU)

(73) Assignee: Joy MM Delaware, Inc., Wilmington, DE (US)

( * ) Notice: Subject to any disclaimer, the term of this patent is extended or adjusted under 35 U.S.C. 154(b) by 0 days.

(21) Appl. No.: 14/180,725

(22) Filed: Feb. 14, 2014

(65) Prior Publication Data

US 2014/0232171 A1 Aug. 21, 2014

Related U.S. Application Data

(60) Provisional application No. 61/765,390, filed on Feb. 15, 2013.

(51) Int. Cl.
*E21C 35/22* (2006.01)
*E21F 5/20* (2006.01)
*E21C 27/24* (2006.01)

(52) U.S. Cl.
CPC ..... *E21C 35/223* (2013.01); *E21C 27/24* (2013.01); *E21F 5/20* (2013.01)

(58) Field of Classification Search
CPC ..... E21C 35/223; E21C 35/22; E21F 5/00; E21F 5/20
USPC ..... 299/9; 37/328
See application file for complete search history.

(56) References Cited

U.S. PATENT DOCUMENTS

| | | | | |
|---|---|---|---|---|
| 3,169,797 | A | 2/1965 | Lundquist | |
| 3,810,677 | A | 5/1974 | David | |
| 4,266,829 | A * | 5/1981 | Divers | 299/64 |
| 4,463,973 | A | 8/1984 | Westphal | |
| 4,952,000 | A | 8/1990 | Lipinski et al. | |
| 5,082,331 | A * | 1/1992 | LeBegue et al. | 299/64 |
| 5,188,427 | A | 2/1993 | LeBegue et al. | |
| 5,253,925 | A | 10/1993 | Modzik, Jr. | |
| 5,597,393 | A | 1/1997 | Johnson et al. | |
| 6,007,157 | A | 12/1999 | Stewart | |
| 2005/0268499 | A1 * | 12/2005 | Weinrib et al. | 37/326 |
| 2011/0221259 | A1 | 9/2011 | Schaffer | |
| 2012/0018544 | A1 | 1/2012 | Chugh | |
| 2012/0073445 | A1 * | 3/2012 | Plush | 96/322 |
| 2012/0104831 | A1 | 5/2012 | Rieger et al. | |
| 2012/0272552 | A1 * | 11/2012 | Tack | 37/328 |

OTHER PUBLICATIONS

PCT/US2014/16410 International Search Report and Written Opinion dated Jun. 13, 2014 (13 pages).

* cited by examiner

*Primary Examiner* — David Bagnell
*Assistant Examiner* — Michael Goodwin
(74) *Attorney, Agent, or Firm* — Michael Best & Friedrich LLP

(57) ABSTRACT

A mining machine includes a boom, a cutter head, a valve, and an actuator. The boom defines an internal chamber and includes a first end coupled to a frame, a second end, and an opening in fluid communication with the internal chamber. The cutter head includes a plurality of cutting bits and is supported on the second end of the boom. The valve is coupled to the boom and is movable between a closed position in which the opening is covered and an open position in which the opening is at least partially uncovered. The actuator is coupled to the valve to selectively move the valve between the closed position and the opened position.

26 Claims, 6 Drawing Sheets

AIR FLOW SYSTEM FOR MINING MACHINE

CROSS-REFERENCE TO RELATED APPLICATIONS

This application claims the benefit of U.S. Provisional Patent Application No. 61/765,390, filed Feb. 15, 2013, the entire contents of which are incorporated by reference herein.

BACKGROUND

The present invention relates to mining machines. Specifically, the present invention relates to an air flow system for a continuous mining machine.

Conventional continuous mining and entry development machines include an air flow system proximate the mine face to remove cut material and contaminants. During operation, the cutter head frequently changes position, ranging between the mine floor and the roof. Current machines draw air from the cutting face through the cutter frame. The movement of the cutter head changes the position at which air is drawn into the air flow system. In addition, the tight underground environment imposes significant spatial constraints on entry development machines and continuous mining machines, limiting the amount of space on the machine for various components.

SUMMARY

In one aspect, the invention provides a continuous miner including a frame, a boom, a cutter head, a valve, and an actuator. The boom defines an internal chamber and includes a first end coupled to the frame, a second end, and an opening in fluid communication with the internal chamber. The cutter head includes a plurality of cutting bits and is supported on the second end of the boom. The valve is coupled to the boom and is movable between a closed position in which the opening is covered and an open position in which the opening is at least partially uncovered. The actuator is coupled to the valve to selectively move the valve between the closed position and the opened position.

In another aspect, the invention provides a boom for a continuous mining machine having a frame and a cutter head. The boom includes an elongated shell, an opening, a valve, and an actuator. The boom has a first end configured to be coupled to the frame and a second end configured to support the cutter head. The shell defines an outer surface and an internal chamber. The outer surface has an upper portion and a lower portion. The opening is positioned on the lower surface and is in fluid communication with the internal chamber. The valve is movable between a closed position in which the opening is covered and an open position in which the opening is at least partially uncovered. The actuator is coupled to the valve to selectively move the valve between the closed position and the opened position.

In yet another aspect, the invention provides a continuous mining machine including a frame, a boom, a cutter head, a plate, an actuator, a sensor for detecting a position of the cutter head, and a control system for operating the actuator based on the sensed position of the cutter head. The boom defines an upper surface, a lower surface, and an internal chamber. The boom includes a first end coupled to the frame, a second end, and an opening positioned on the lower surface and in fluid communication with the internal chamber. The cutter head includes a plurality of cutting bits and is supported on the second end of the boom. The plate is coupled to the boom and is movable from a closed position in which the opening is covered toward an open position in which the opening is at least partially uncovered. The actuator is coupled to the plate to selectively move the plate between the closed position and the opened position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

Figure 1:
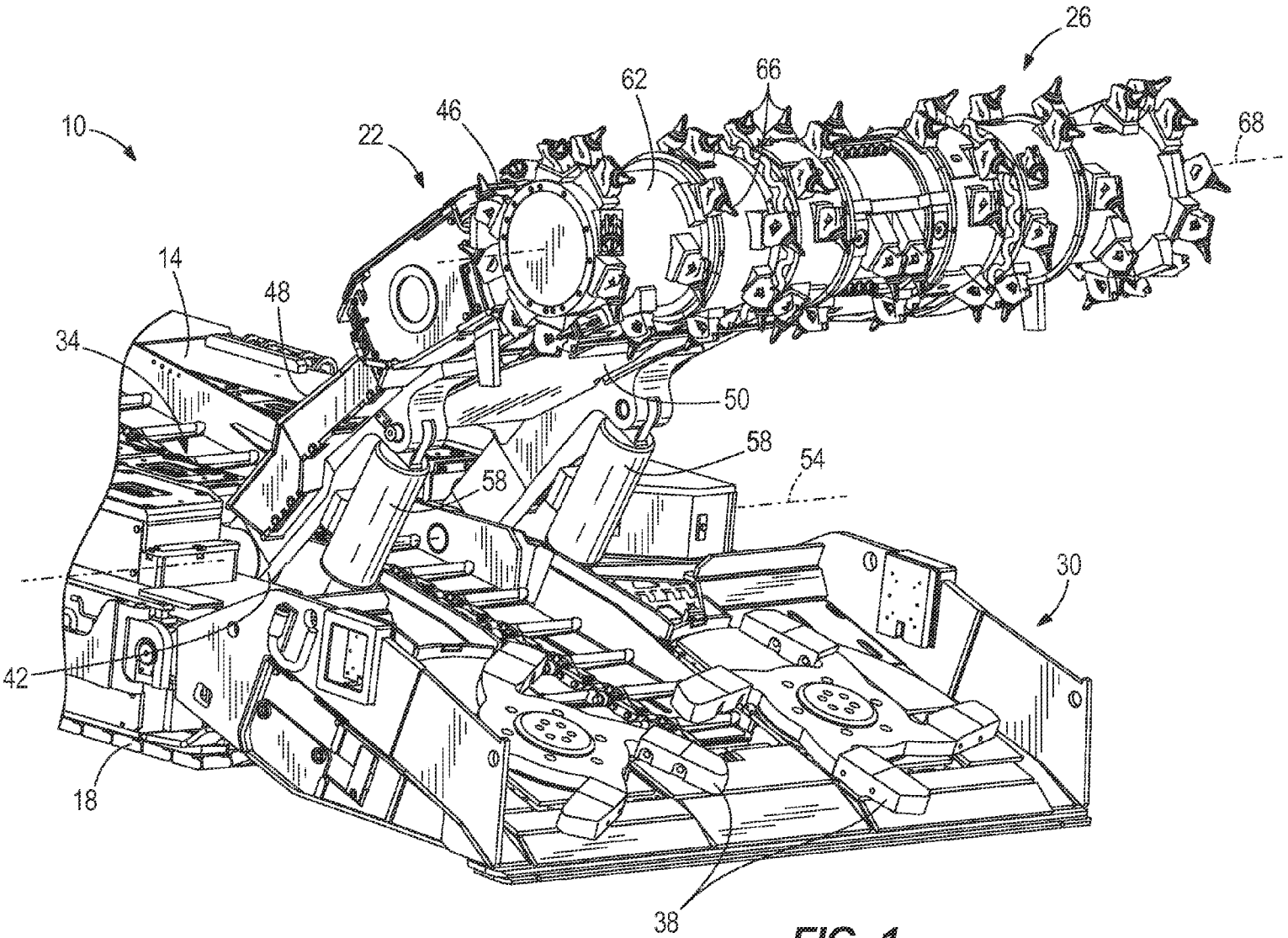
FIG. 1 is a front perspective view of a portion of a mining machine.

FIG. 1 illustrates a portion of a mining machine, such as a continuous miner 10, including a frame 14 that is supported for movement by tracks 18. The continuous miner 10 further includes a boom 22 and a cutter head 26. In the illustrated embodiment, the frame 14 also includes a gathering head 30 and a conveyor 34. The gathering head 30 includes a pair of rotating arms 38 that urge the cut material below the cutter head 26 onto the conveyor 34. The conveyor 34 extends from one end of the frame 14 toward the other end (not shown) of the frame 14. The conveyor 34 transports cut material from the area below the cutter head 26 to a second conveyor (not shown) positioned behind the frame 14.

In the illustrated embodiment, the boom 22 is formed as a shell and includes a first end 42 pivotably coupled to the frame 14 and a second end 46 supporting the cutter head 26. The boom 22 also defines an upper surface 48 and a lower surface 50. The boom 22 is pivotable about a pivot axis 54 that is generally transverse to a longitudinal axis of the frame 14. The boom 22 is pivoted by a pair of actuators 58 that are coupled between the frame 14 and the boom 22. In the illustrated embodiment, the actuators 58 are hydraulic jacks or cylinders.

In the illustrated embodiment, the cutter head 26 is formed as an elongated drum 62 including a plurality of cutting bits 66 secured to an outer surface of the drum 62. The drum 62 defines a drum axis 68 that is generally parallel to the pivot axis 54 of the boom 22, and the drum 62 is rotatable about the drum axis 68.

Figure 2:
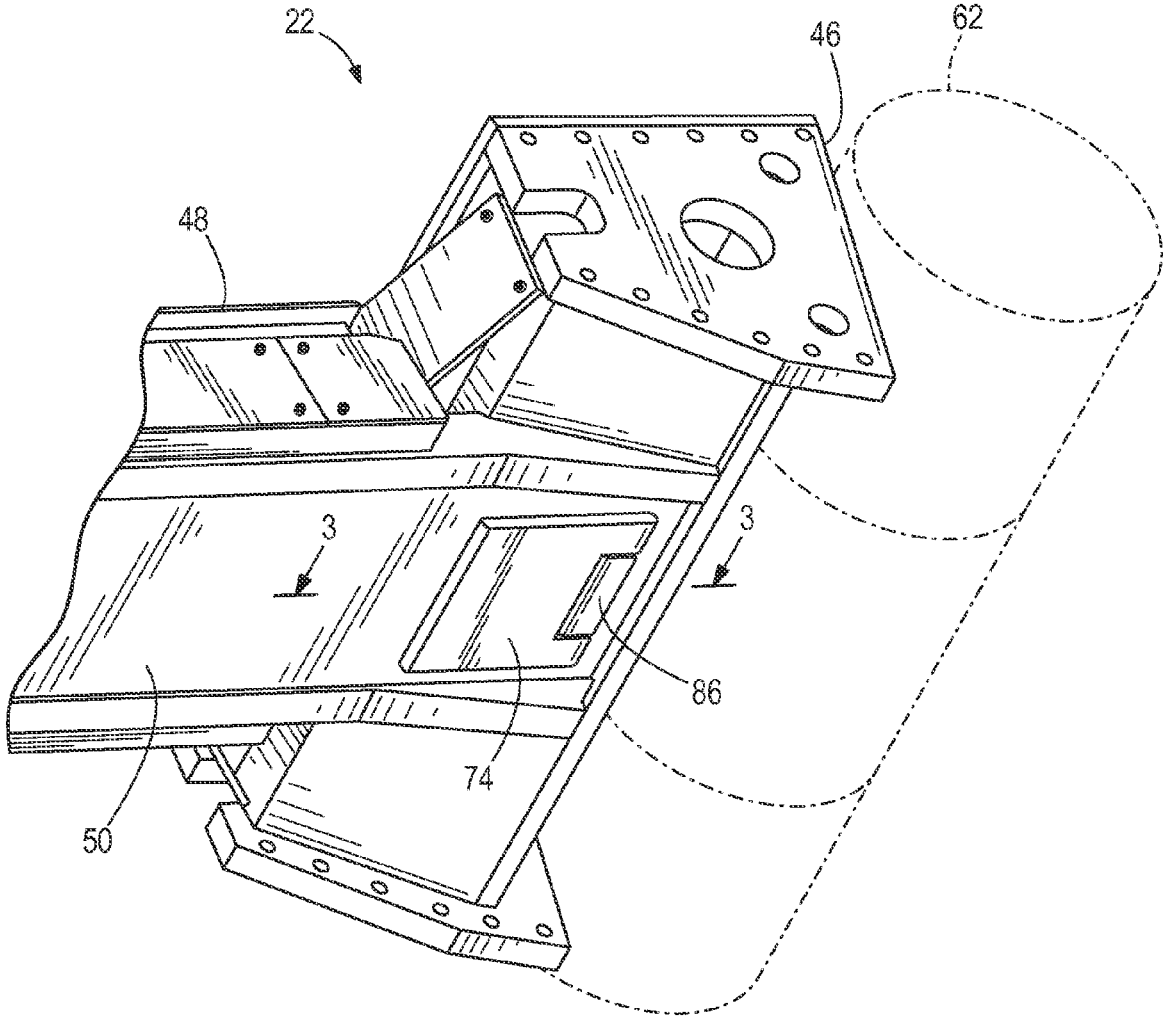
FIG. 2 is a lower perspective view of an end of a boom including a valve plate in a closed position.
Figure 3:
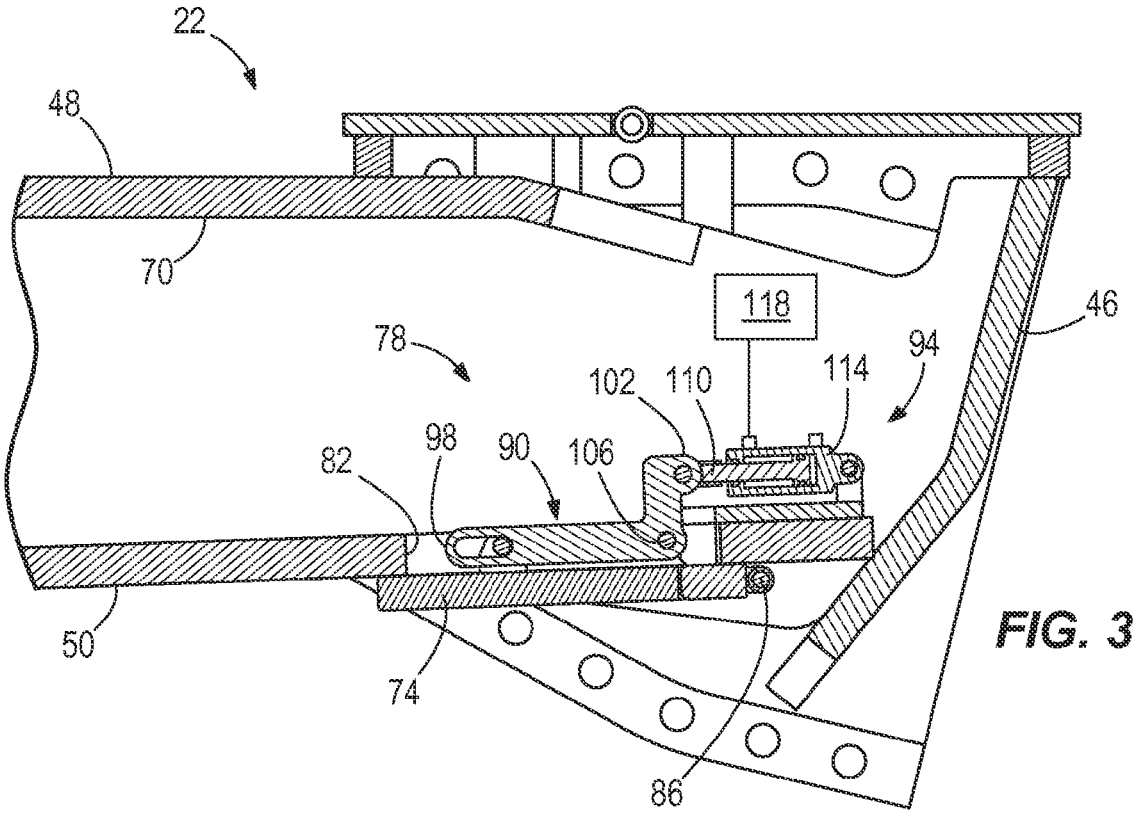
FIG. 3 is a side section view of the boom of FIG. 2 with the valve plate in a closed position.
Figure 4:
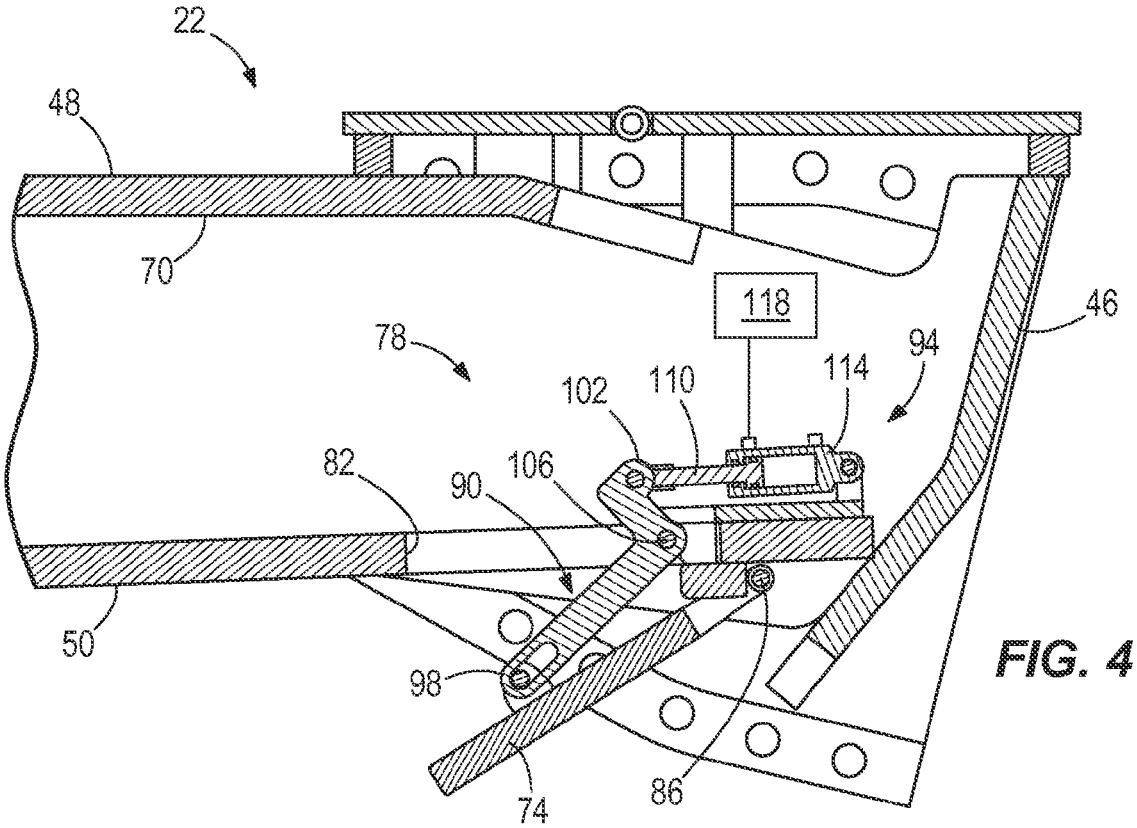
FIG. 4 is a side section view of the boom of FIG. 3 with the valve plate in an opened position.

As shown in FIGS. 2-4, the boom 22 also includes a ventilation duct or air flow duct 70 (FIGS. 3 and 4), a valve or plate 74, and an actuator 78 (FIGS. 3 and 4). The duct 70 is defined by an internal chamber of the boom 22 and extends substantially between the second end 46 of the boom 22 and the first end 42 (FIG. 1). The duct 70 is in fluid communication with a suction source (not shown) and includes a port or opening 82 (FIGS. 3 and 4) on the boom 22.

As best shown in FIGS. 3 and 4, the plate 74 selectively covers the opening 82. In the illustrated embodiment, the plate 74 is positioned on the lower surface 50 of the boom 22. The plate 74 is pivotably connected to the boom 22 by a hinge 86 and can pivot between a closed position (FIG. 3), an open position (FIG. 4), and any position between the closed position and the open position. The hinge 86 is positioned proximate the second end 46 of the boom 22 so that the plate 74 opens downwardly and toward the cutter head 26. Stated another way, the plate 74 opens away from the cutter head 26, creating a passage to the opening 82 that is oriented away from the cutter head 26. In other embodiments, the plate 74 may open to create a passage to the opening 82 that is oriented toward the cutter head 26 and toward the second end 46 of the boom 22. Furthermore, in other embodiments the plate 74 is slidable relative to the boom 22 to cover and uncover the opening 82. The plate 74 may be actuated or slid by a rack connection.

Referring to FIGS. 3 and 4, the actuator 78 includes an arm 90 and a piston-cylinder device 94. The arm 90 includes a first end 98 coupled to the valve plate 74 and a second end 102 coupled to the piston-cylinder device 94. The arm 90 is pivotably coupled to the boom 22 by a pin 106. The piston-cylinder device 94 includes a piston 110 that is received within a cylinder 114 and is linearly extendable relative to the cylinder 114 (e.g., by a pressurized fluid). The piston 110 is coupled to the arm 90 such that extension and retraction of the piston 110 moves the arm 90, thereby opening and closing the valve plate 74. In other embodiments, the piston-cylinder device 94 may be substituted with another type of linear actuator, such as a solenoid. In still other embodiments, the arm 90 may be moved by a rotary actuator.

In the illustrated embodiment, the actuator 78 is positioned within the boom 22. In some embodiments, the plate 74 may also be positioned within the boom 22 and coupled to the internal chamber. Positioning the duct 70, the actuator 78, the plate 74, and/or any other components within the boom 22 reduces the components' exposure to the working end of the machine 10 and debris cut from the mine face, thereby reducing the possibility of damage to the components.

Figure 5:
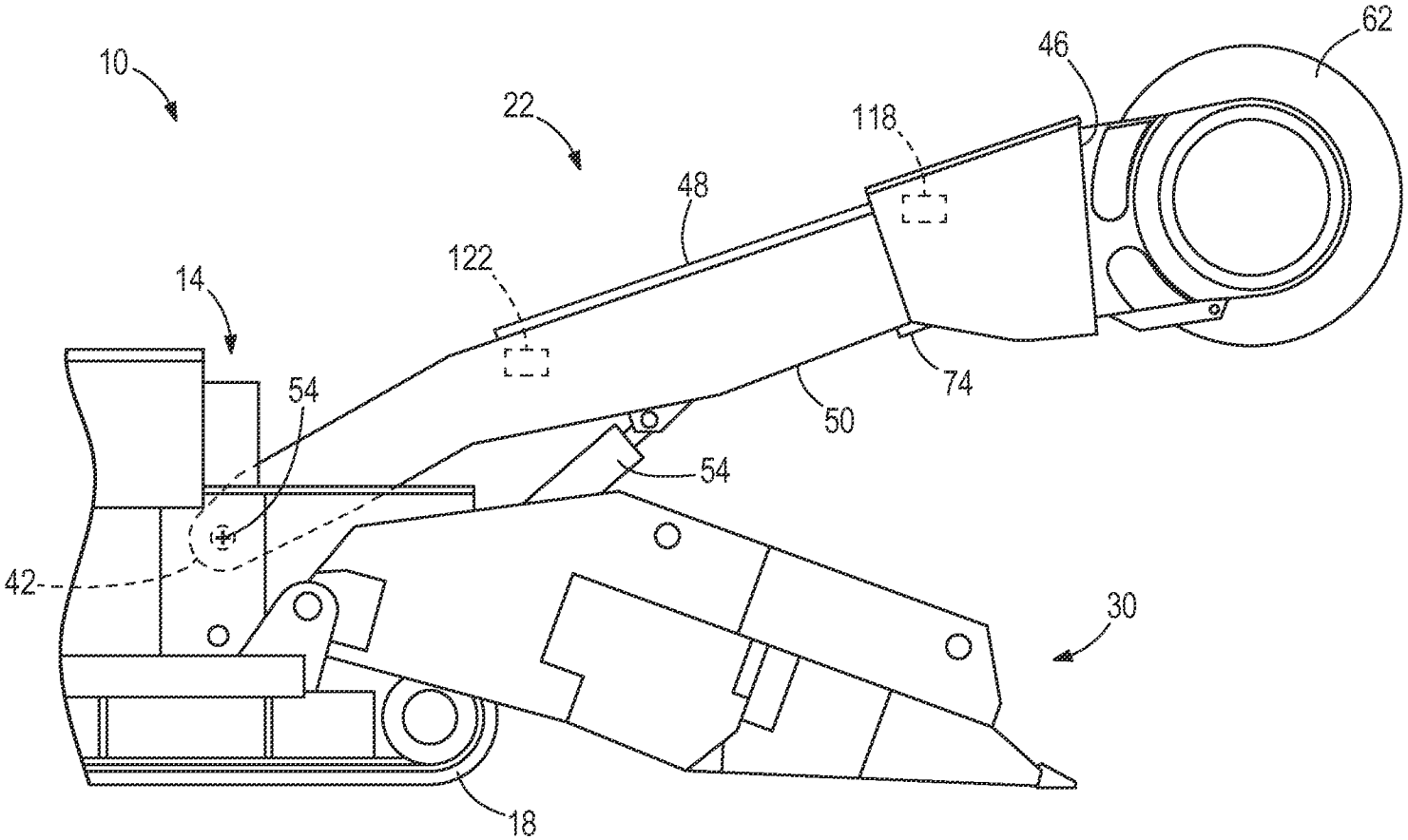
FIG. 5 is a side view of the portion of the mining machine of FIG. 1.
Figure 6:
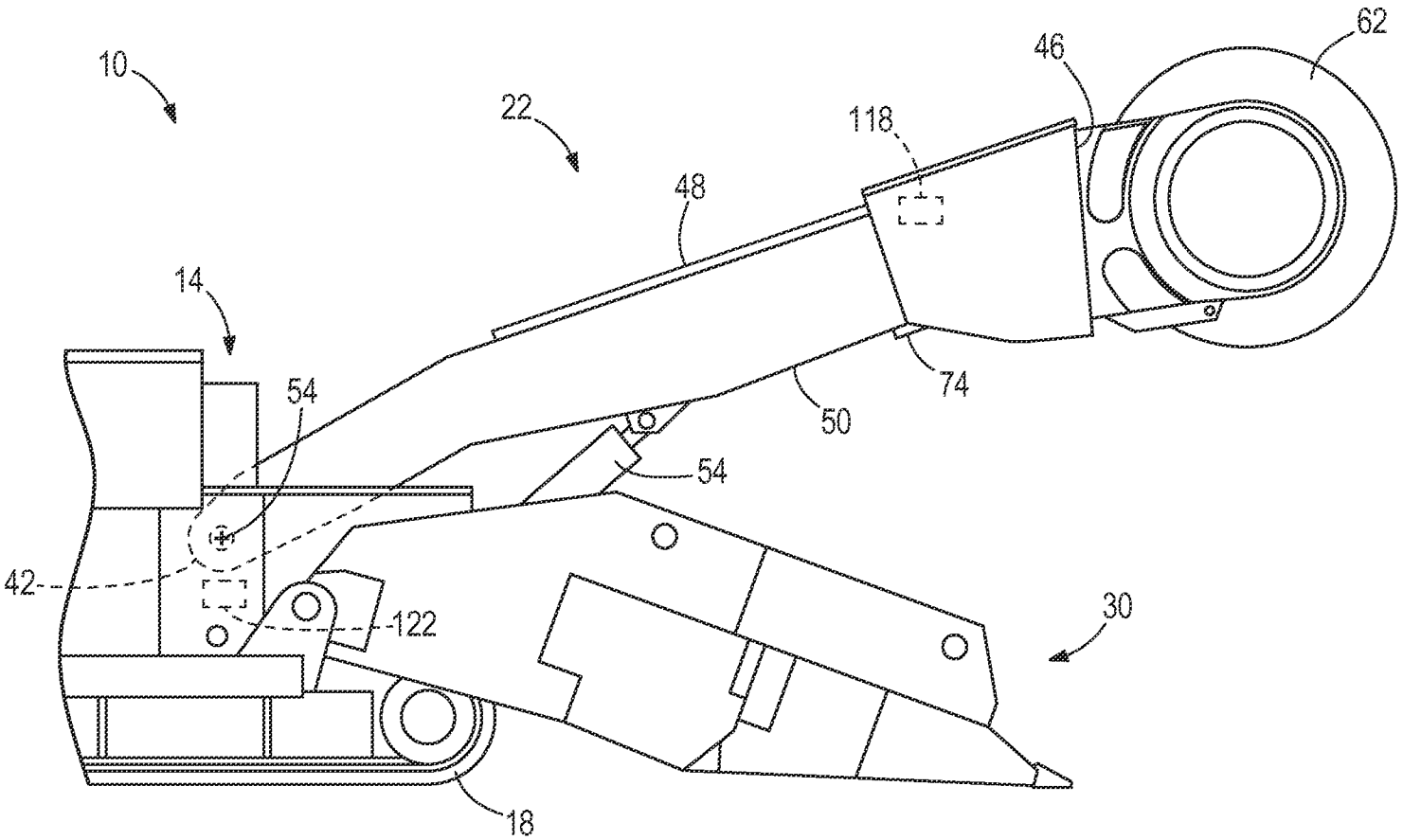
FIG. 6 is a side view of a portion of a mining machine according to another embodiment.
Figure 7:
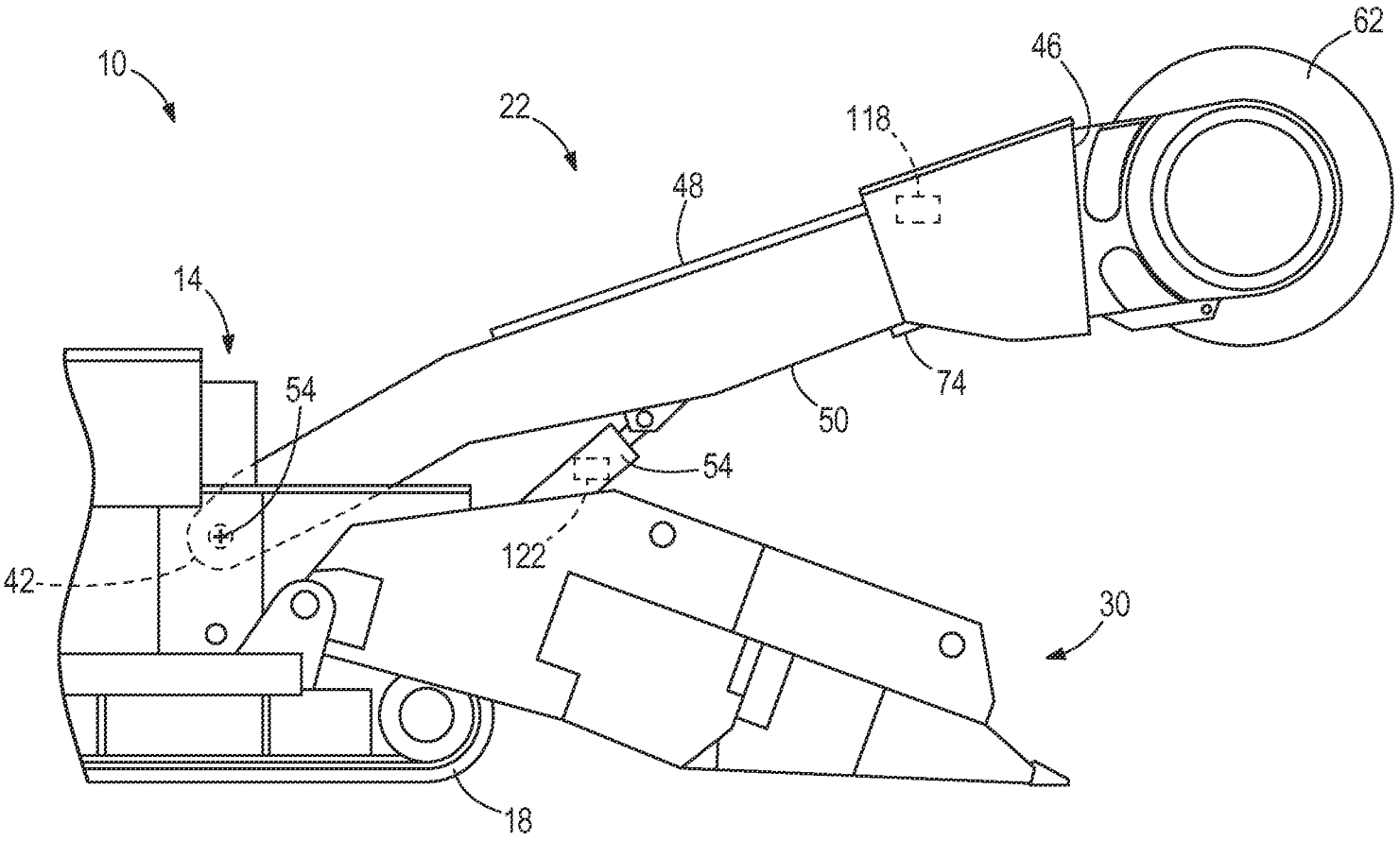
FIG. 7 is a side view of a portion of a mining machine according to another embodiment.

The actuator 78 is operated by a control system 118. In the illustrated embodiment, the controller 118 drives a flow control valve to direct fluid to either side of the cylinder 114, thereby moving the piston 110. The control system 118 receives input (e.g., by a wired connection or a wireless connection) from a sensor 122 that detects the position of the boom 22 relative to the frame 14 and/or detects the height of the cutter head 26. Referring to FIG. 5, in one embodiment the sensor 122 is an inclinometer that detects the inclination angle of the boom 22 and determines the height of the cutter head 26. As shown in FIG. 6, in another embodiment the sensor 122 is a rotary sensor (e.g., an encoder) that detects the rotation of the boom 22 about the pivot axis 54 and determines the height of the cutter head 26. Referring to FIG. 7, in another embodiment the sensor 122 is a linear sensor that detects the extension of the actuators 58 to measure the rotation of the boom 22 and determine the height of the cutter head 26.

The controller 118 operates the actuator 78 to move the plate 74 based on the sensed position of the cutter head 26. For example, when the sensor 122 detects that the cutter head 26 is in the fully raised position, the control system 118 actuates the flow control valve to extend the piston 110, thereby at least partially exposing the opening 82 (FIG. 3) to provide fluid communication with the duct 70. When the cutter head 26 is lowered, the control system 118 actuates the flow control valve to retract the piston 110 and move the plate 74 toward a closed position. In one embodiment, the plate 74 completely closes the opening 82 once the cutter head 26 moves below a pre-determined height to ensure that cut material is not sucked into the duct 70.

Positioning an opening for a suction system on a lower surface of a boom has been impractical for conventional mining machines because it causes cut material to be sucked into a ventilation duct when the boom and cutter head are in a lowered position. Similarly, positioning the opening on an upper surface of the boom on a conventional mining machine would result in the top of the duct being obstructed or blocked by the mine roof when the cutter head is in a raised position. However, the optimally-shaped opening 82 on the underside of the boom 22 improves average ventilation flow rates, and significantly improves flow rates when the cutter head 26 is in the raised position. The ventilation performance near the cutting face is therefore improved by implementing a controlled valve 74 in which the size of the air flow passage is adjusted depending on the position of the cutter head 26. In one embodiment, the passage formed by the valve 74 is smaller when the boom 22 and cutter head 26 are positioned closer to the ground, thereby reducing the amount of debris and material that is sucked in from the ground. The valve 74 is progressively opened as the cutter head 26 is raised and progressively closed as the cutter head 26 is lowered. In some embodiments, the valve 74 may be completely closed when the cutter head 26 is below a predetermined height and is completely open when the cutter head 26 is above the predetermined height.

The control system 118 can open and close the opening 82 based on any of several sensor inputs. For example, in the embodiment of FIG. 5, the inclinometer 122 indicates the orientation of the boom 22 and the control system 118 determines the height of the cutter head 26 as a result. In the embodiment of FIG. 6, the cutter head 26 position is calculated based on the measured rotation angle of the boom 22. In the embodiment of FIG. 7, the measured extension of the actuators 58 indicates the rotation of the boom 22, and the control system 118 can determine the position of the cutter head 26. Based on the sensed inputs, the control system 118 opens the valve 74 accordingly. In addition, in other embodiments, the volume flow can be optimized by varying or adjusting the position of the valve 74 based on differential pressure feedback within the air flow circuit.

Thus, the invention provides, among other things, an air flow system for a mining machine. Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. A mining machine comprising:

a frame;

a boom defining an internal chamber, the boom including a first end coupled to the frame, a second end, and an opening in fluid communication with the internal chamber;

a cutter head including a plurality of cutting bits and supported on the second end of the boom;

an endless conveyor for transporting cut material away from the cutter head, the endless conveyor supported on the frame;

a collecting mechanism including an arm for contacting and directing cut material onto the endless conveyor;

a valve coupled to the boom, the valve movable between a closed position in which the opening is covered and an open position in which the opening is at least partially uncovered; and an actuator coupled to the valve to selectively move the valve between the closed position and the opened position.

2. The mining machine of claim 1, wherein the boom defines a lower surface, and the opening is located on the lower surface.

3. The mining machine of claim 1, wherein the valve includes a plate that is pivotably coupled to the boom by a hinge such that the plate pivots relative to the boom through an angle.

4. The mining machine of claim 3, wherein the hinge is positioned proximate the cutter head, such that the plate pivots toward the cutter head when the plate is moved to the open position.

5. The mining machine of claim 1, wherein the valve is progressively opened as the boom is raised.

6. The mining machine of claim 1, wherein the actuator includes an arm and a linearly movable member, the arm including a first end coupled to the valve and a second end coupled to the member, the arm being pivotable relative to the boom about a pin.

7. The mining machine of claim 6, wherein the linearly movable member includes a fluid piston and cylinder device.

8. The mining machine of claim 1, further comprising a control system for operating the actuator and a sensor for detecting a position of the cutter head relative to the frame.

9. The mining machine of claim 1, wherein the internal chamber is in fluid communication with a suction source such that a suction force is applied at the opening when the valve is in the open position.

10. A boom for a mining machine having a frame and a cutter head, the boom comprising:

an elongated shell having a first end configured to be coupled to the frame and a second end configured to support the cutter head, the shell defining an upper surface, a lower surface, and an internal chamber;

an opening positioned on the lower surface and in fluid communication with the internal chamber;

a valve movable between a closed position in which the opening is covered and an open position in which the opening is at least partially uncovered; and an actuator coupled to the valve to selectively move the valve between the closed position and the opened position;

a control system for operating the actuator and a sensor for detecting a position of the second end of the boom relative to the first end of the boom.

11. The boom of claim 10, wherein the valve includes a plate that is pivotably coupled to the shell by a hinge such that the plate pivots relative to the shell through an angle.

12. The boom of claim 11, wherein the opening and the plate are positioned proximate the second end of the shell, and wherein the plate opens away from the second end of the shell.

13. The boom of claim 10, wherein the actuator includes an arm and a linearly movable member, the arm including a first end coupled to the valve and a second end coupled to the member, the arm being pivotable relative to the boom about a pin.

14. The boom of claim 13, wherein the linearly movable member includes a fluid piston.

15. The boom of claim 10, wherein the actuator is positioned within the shell.

16. The boom of claim 10, further comprising boom actuators for moving the boom relative to the frame, wherein the sensor detects the extension of the boom actuators.

17. The boom of claim 10, wherein the elongated shell is pivotable between a first position and a second position, wherein the plate is in the opened position when the elongated shell is in the first position, and the plate is in the closed position when the elongated shell is in the second position.

18. The boom of claim 10, wherein the sensor includes an inclinometer for detecting the orientation of the boom.

19. The boom of claim 10, wherein the sensor detects the position of the second end of the boom relative to the first end of the boom by sensing a rotation angle of the boom.

20. The boom of claim 10, wherein the internal chamber is in fluid communication with a suction source such that a suction force is applied at the opening when the valve is in the open position.

21. A mining machine comprising:

a frame;

a boom defining an upper surface, a lower surface, and an internal chamber, the boom including a first end coupled to the frame, a second end, and an opening positioned on the lower surface and in fluid communication with the internal chamber;

a cutter head including a plurality of cutting bits and supported on the second end of the boom;

a plate coupled to the boom, the plate being movable from a closed position in which the opening is covered toward an open position in which the opening is at least partially uncovered;

an actuator coupled to the plate to selectively move the plate between the closed position and the opened position;

a sensor for detecting a position of the cutter head; and a control system for operating the actuator based on the sensed position of the cutter head.

22. The mining machine of claim 21, wherein the plate is pivotably coupled to the boom by a hinge such that the plate pivots relative to the boom through an angle.

23. The mining machine of claim 22, wherein the actuator includes an arm and a linearly movable member, the arm including a first end coupled to the plate and a second end coupled to the member.

24. The mining machine of claim 23, wherein the arm is pivotable relative to the boom about a pin.

25. The mining machine of claim 21, further comprising boom actuators for moving the boom relative to the frame, wherein the sensor detects the extension of the boom actuators.

26. The mining machine of claim 21, wherein the internal chamber is in fluid communication with a suction source such that a suction force is applied at the opening when the plate is in the open position.

* * * * *